US006382118B1

(12) United States Patent
Wolf

(10) Patent No.: US 6,382,118 B1
(45) Date of Patent: May 7, 2002

(54) SEWING MACHINE WITH A PRESSER FOOT MECHANISM

(75) Inventor: Johann Wolf, Sambach (DE)

(73) Assignee: G.M. Pfaff Aktiengesellschaft In Insolvenz (DE)

( * ) Notice: Subject to any disclaimer, the term of this patent is extended or adjusted under 35 U.S.C. 154(b) by 0 days.

(21) Appl. No.: 09/935,801

(22) Filed: Aug. 23, 2001

(30) Foreign Application Priority Data

Aug. 25, 2000 (DE) ..... 200 14 726

(51) Int. Cl.[7] ..... D05B 29/02; D05B 69/10

(52) U.S. Cl. ..... 112/239

(58) Field of Search ..... 112/235, 237, 112/238, 239, 60, 61, 114

(56) References Cited

U.S. PATENT DOCUMENTS 5,687,659 A * 11/1997 Matsunaga et al. .... 112/470.01
5,937,775 A * 8/1999 Ku ..... 112/239

FOREIGN PATENT DOCUMENTS

DE 199 45 443 7/2000

* cited by examiner

*Primary Examiner*—Peter Nerbun
(74) *Attorney, Agent, or Firm*—McGlew and Tuttle, P.C.

(57) ABSTRACT

A sewing machine is provided with a presser foot mechanism having a pressure bar and a presser foot, and with a linear motor (20) as an adjusting element. The linear motor (20) is arranged at least partially in the arm (2) of the machine housing and the drive bar (19) of the linear motor (20) is connected via an angle lever (14) to a spring bracket (7) holding a spring (9). The spring bracket (7) is also connected to the pressure bar (4).

7 Claims, 2 Drawing Sheets

SEWING MACHINE WITH A PRESSER FOOT MECHANISM

FIELD OF THE INVENTION

The present invention pertains to a sewing machine with a housing having an arm and a head, with a presser foot mechanism, comprising a pressure bar and a presser foot, and with a linear motor as an adjusting element for the presser foot mechanism, wherein a spring is arranged between the drive bar of the linear motor and the pressure bar.

BACKGROUND OF THE INVENTION

Two exemplary embodiments of a presser foot mechanism, in which a spring acting as a low-weight coupling element is arranged between the drive bar of the linear motor and the pressure bar, are disclosed in DE 199 45 443 A1. In a first exemplary embodiment, the linear motor is arranged vertically above the pressure bar and the spring is designed as a coil spring. Due to the relatively large dimensions of the linear motor in terms of its diameter and its length, it could not be arranged within but only outside the housing head. However, this would compromise not only the handling of the sewing machine, but also its appearance.

In a second exemplary embodiment, the linear motor is arranged at a laterally spaced location from the pressure bar and the spring is designed as a leaf spring bridging over the distance between the drive bar and the pressure bar. Even though it appears to be more possible in this design to accommodate the linear motor within the machine housing, the drive bar and the pressure bar and their mounts are, however, subject to strong jamming forces and increased wear because strong horizontal force components also occur besides the vertically directed forces in the case of such an arrangement of a leaf spring.

SUMMARY AND OBJECTS OF THE INVENTION

The basic object of the present invention is therefore to provide a presser foot mechanism to be operated with a linear motor, which can be accommodated together with the linear motor at least extensively within the machine housing and operates with low wear.

According to the invention, a sewing machine is provided with a housing having an arm and a head, with a presser foot mechanism or means. The presser foot mechanism comprises a pressure bar and a presser foot. A linear motor is provided as an adjusting element for the presser foot mechanism. A spring is arranged between the drive bar of the linear motor and the pressure bar. The linear motor is arranged at least partially in the arm and its drive bar is connected via an angle lever to a spring bracket holding the spring. The spring bracket is connected to the pressure bar.

Due to the arrangement of an angle lever and the measure of mounting the spring in a bracket, which is connected to the angle lever, on the one hand, and to the pressure bar, on the other hand, the linear motor can be accommodated at least partially within the housing arm, so that it does not compromise the handling of the sewing machine and is, moreover, extensively protected from damage.

The connection between the drive bar and one arm of the angle lever as well as between the other arm of the angle lever and the spring bracket can be designed as an elongated hole-and-pin connection according or it can be brought about by a connecting rod.

The design of the spring bracket as comprising an upper holding piece associated with the angle lever and a lower holding piece associated with the pressure bar and that the two holding pieces are connected to one another by a screw, wherein the spring arranged between the two holding pieces is pretensioned leads to a detachable connection between the angle lever and the pressure bar. In the variant wherein the linear motor, the angle lever and the upper holding piece of the spring bracket are arranged together on a carrier plate detachably fastened on or in the arm, it makes it possible to connect the linear motor designed as a built-in assembly unit together with the angle lever to the pressure bar in terms of drive after the mounting in the machine housing by inserting the screw.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
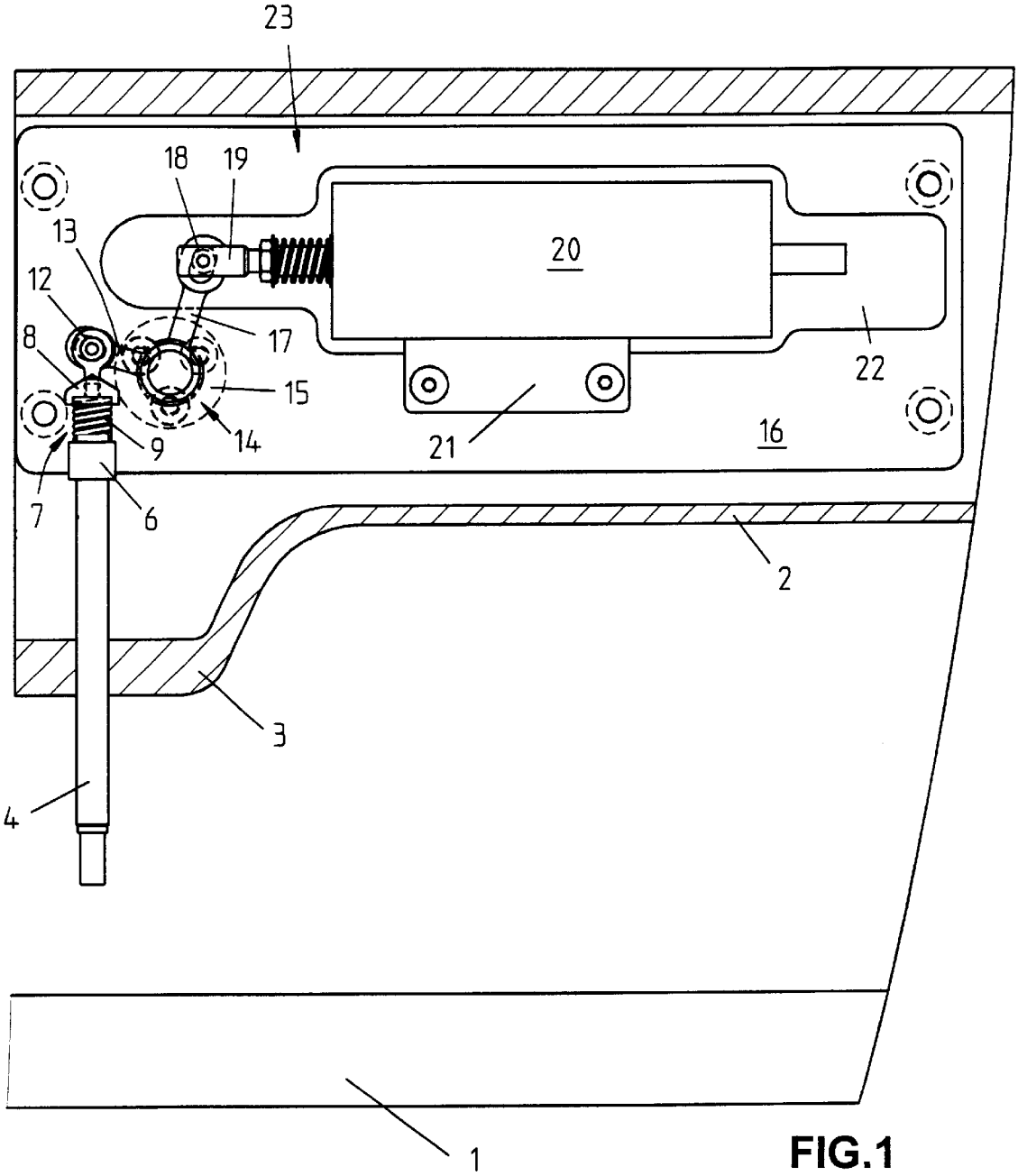
FIG. 1 is a partially cut-away view of part of a sewing machine.

Referring to the drawings in particular, of the sewing machine, only part of the base plate 1 as well as part of the housing arm 2 with the head 3 are shown.

A pressure bar 4, which carries a presser foot 5 at its lower end, is mounted in the head 3. The pressure bar 4 and the presser foot 5 together form a presser foot mechanism.

A holding piece 6, which is part of a spring bracket 7, is clamped at the top end of the pressure bar 4. The spring bracket 7 contains another holding piece 8 above the holding piece 6. A compression coil spring 9 is accommodated between the two holding pieces 6, 8. The two holding pieces 6, 8 are connected to one another by a screw 10, and the spring 9 located between them is pretensioned. The lower holding piece 6 is thus held under spring force in contact with the screw head 11. The two holding pieces 6, 8 can be moved toward each other by compressing the spring 9.

The top end of the upper holding piece 8 is connected to a first arm 13 of an angle lever 14 in an articulated manner by means of an elongated hole-and-pin connection 12. The angle lever 14 is mounted pivotably on a mounting plate 15, which is in turn screwed onto a comparatively much larger carrier plate 16.

A second arm 17 of the angle lever 14 is connected in an articulated manner to the drive bar 19 of a linear motor 20 extending horizontally with its longitudinal axis by means of another elongated hole-and-pin connection 18.

The design and function of the linear motor 20 correspond to those of the linear motor shown in FIG. 5 of DE 199 45 443 A1 mentioned in the introduction. The linear motor 20 is fastened to the carrier plate 16 by means of a bracket 21. The linear motor 20 with its drive bar 19 extends within an opening 22 of the carrier plate 16.

The carrier plate 16 with the linear motor 20, with the angle lever 14 and with the upper holding piece 8 forms a built-in assembly unit 23 which can be preassembled. The built-it assembly unit 23 is mounted on the sewing machine such that the carrier plate 16 is screwed onto the outside of the arm 2.

Figure 2:
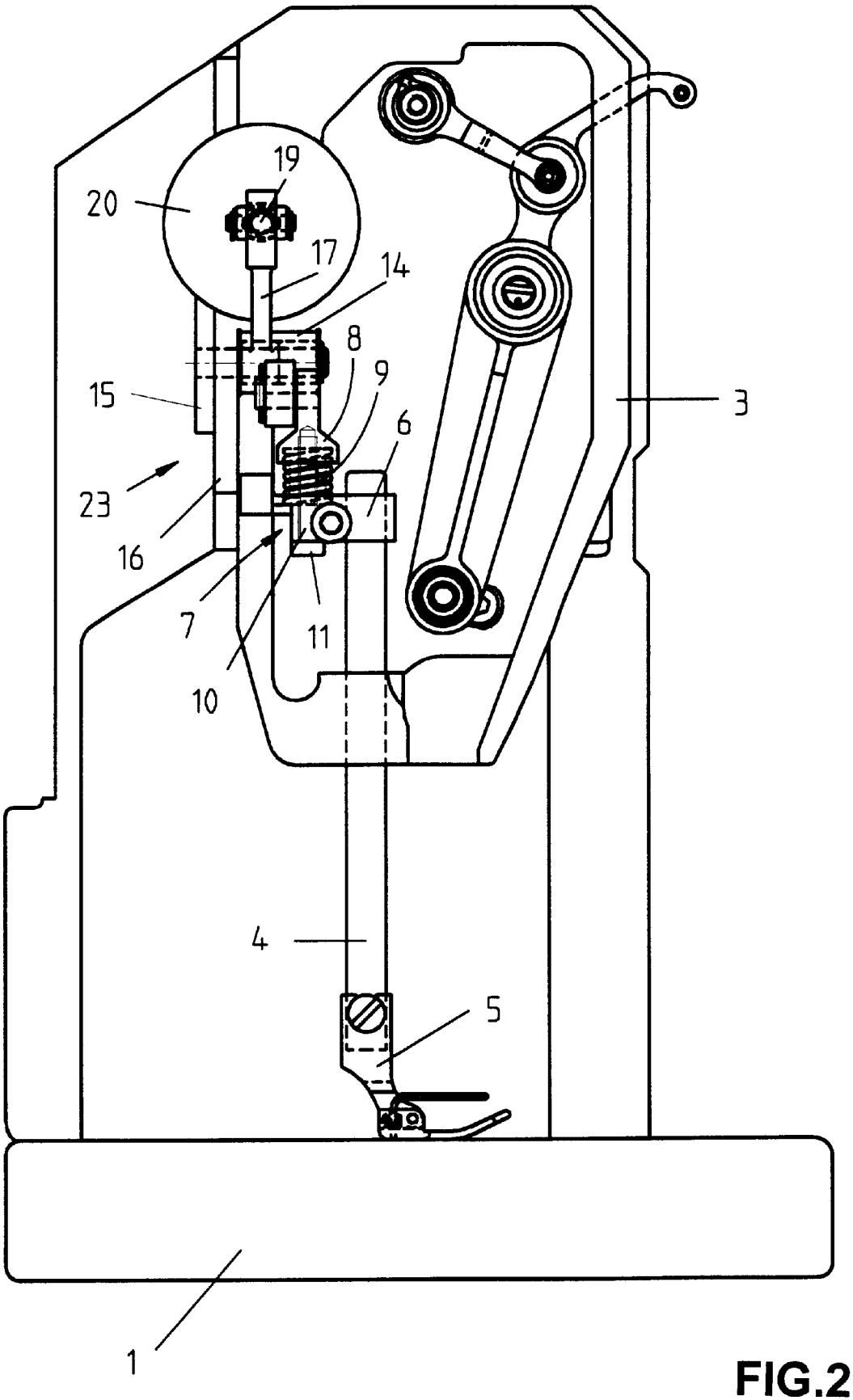
FIG. 2 is a side view of the sewing machine.

According to FIG. 2, most of the linear motor 20 will then protrude into the interior of the housing. The smaller part of the linear motor 20 located outside the arm 2 is covered by means of a cover which can be arranged on the machine housing.

After the mounting of the built-in assembly unit 23, the spring 9 is inserted between the two holding pieces 6, 8. The two holding pieces 6, 8 are then connected to one another by means of the screw 10, the spring 9 being pretensioned, as was mentioned above. The drive bar 19 of the linear motor 20 is now connected in terms of drive to the pressure bar 4.

The pretension of the spring 9 can be set at a predetermined value because the screw 10 is not screwed in against a stop but only to the extent needed to achieve the desired spring pretension. The screwed-in position of the screw 10 can be secured in this case by means of a stud screw directed at right angles, not shown.

While specific embodiments of the invention have been shown and described in detail to illustrate the application of the principles of the invention, it will be understood that the invention may be embodied otherwise without departing from such principles.

What is claimed is:

1. A sewing machine, comprising:

a housing having an arm and a head;

a presser foot mechanism comprising a pressure bar and a presser foot;

a linear motor as an adjusting element for the presser foot mechanism, said linear motor having a drive bar, said linear motor being arranged at least partially in said arm;

a spring arranged between said drive bar and said pressure bar;

a spring bracket holding said spring, said spring bracket being connected to said pressure bar; and an angle lever connecting said drive bar to said spring bracket.

2. A sewing machine in accordance with claim 1, wherein a connection between said drive bar and said angle lever is an elongated hole-and-pin connection and a connection between said angle lever and said spring bracket is an elongated hole-and-pin connection.

3. A sewing machine in accordance with claim 1, wherein a connection between said drive bar and said angle lever is via a connecting rod and a connection between said angle lever and said spring bracket is via a connecting rod.

4. A sewing machine in accordance with at least claim 1, wherein said spring bracket comprises an upper holding piece associated with said angle lever and a lower holding piece associated with said pressure bar, said upper holding piece and said lower holding piece being connected to one another by a screw, wherein said spring is arranged between said two holding pieces and is pretensioned.

5. A sewing machine in accordance with at least claim 2, wherein said spring bracket comprises an upper holding piece associated with said angle lever and a lower holding piece associated with said pressure bar, said upper holding piece and said lower holding piece being connected to one another by a screw, wherein said spring is arranged between said two holding pieces and is pretensioned.

6. A sewing machine in accordance with at least claim 3, wherein said spring bracket comprises an upper holding piece associated with said angle lever and a lower holding piece associated with said pressure bar, said upper holding piece and said lower holding piece being connected to one another by a screw, wherein said spring is arranged between said two holding pieces and is pretensioned.

7. A sewing machine in accordance with claim 4, wherein said linear motor, said angle lever and said upper holding piece of said spring bracket are arranged together on a carrier plate detachably fastened on or in said arm.

* * * * *